US011375301B2

(12) United States Patent
Huang et al.

(10) Patent No.: US 11,375,301 B2
(45) Date of Patent: Jun. 28, 2022

(54) SPEAKER BOX DEVICE AND MOBILE TERMINAL USING SAME

(71) Applicant: AAC Technologies Pte. Ltd., Singapore (SG)

(72) Inventors: Xingzhi Huang, Shenzhen (CN); Lin Liu, Shenzhen (CN); Dijiang Tong, Shenzhen (CN); Zhe Zhang, Shenzhen (CN); Jun Wu, Shenzhen (CN); Zhichen Chen, Shenzhen (CN); Zhaoyu Yin, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/992,146

(22) Filed: Aug. 13, 2020

(65) Prior Publication Data

US 2021/0029426 A1 Jan. 28, 2021

Related U.S. Application Data

(63) Continuation of application No. PCT/CN2019/097575, filed on Jul. 24, 2019.

(30) Foreign Application Priority Data

Jul. 22, 2019 (CN) ..... 201921159937.8

(51) Int. Cl.
*H04R 1/02* (2006.01)

(52) U.S. Cl.
CPC ..... *H04R 1/02* (2013.01)

(58) Field of Classification Search
CPC ..... H04R 9/022; H04R 2499/11; H05K 7/20136; H05K 7/20145; H05K 7/20154; H05K 7/20445
See application file for complete search history.

(56) References Cited

U.S. PATENT DOCUMENTS

| | | | | |
|---|---|---|---|---|
| 3,778,551 | A * | 12/1973 | Grodinsky | H05K 7/209 381/335 |
| 6,327,144 | B1 * | 12/2001 | May | H01H 13/86 361/679.47 |
| 9,354,677 | B2 * | 5/2016 | Reilly | H05K 7/20136 |
| 9,552,026 | B2 * | 1/2017 | Chang | G06F 1/1656 |
| 10,045,461 | B1 * | 8/2018 | Boozer | H04R 1/00 |
| 10,306,356 | B2 * | 5/2019 | Katz | H04R 1/021 |
| 10,317,960 | B2 * | 6/2019 | Wong | G06F 1/203 |
| 10,425,739 | B2 * | 9/2019 | Xu | H04R 1/345 |
| 10,827,273 | B2 * | 11/2020 | Nussbaum | H04R 9/022 |

(Continued)

FOREIGN PATENT DOCUMENTS

| | | | | |
|---|---|---|---|---|
| GB | 2322500 A | * | 8/1998 | H04B 1/3833 |
| JP | 03211796 A | * | 9/1991 | |

*Primary Examiner* — Ryan Robinson
(74) *Attorney, Agent, or Firm* — W&G Law Group

(57) ABSTRACT

The present application provides a speaker box device having a speaker box, a heating element and a heat conductor. The speaker box includes a housing body and a speaker unit provided with a diaphragm. The heat conductor includes a first end part connected to the heating element, a second end part and a connection part connecting the first end part to the second end part. Heat of the heating element is discharged by means of an air cooling effect, so that the heat dissipation efficiency of the speaker device is ensured.

12 Claims, 3 Drawing Sheets

(56) References Cited

U.S. PATENT DOCUMENTS

| | | | | |
|---|---|---|---|---|
| 10,841,706 | B2 * | 11/2020 | Davis | H04R 9/022 |
| 2011/0164383 | A1 * | 7/2011 | Kadijk | H05K 7/20972<br>361/690 |
| 2013/0312429 | A1 * | 11/2013 | Greuet | F25B 9/14<br>62/6 |
| 2018/0292871 | A1 * | 10/2018 | Weigand | G06F 1/203 |
| 2020/0404402 | A1 * | 12/2020 | Lin | H04R 1/02 |

* cited by examiner

SPEAKER BOX DEVICE AND MOBILE TERMINAL USING SAME

FIELD OF THE PRESENT DISCLOSURE

The present application relates to heat dissipation technology of mobile terminals, in particular to a speaker device with a heat dissipation function and a mobile terminal provided with the speaker device.

DESCRIPTION OF RELATED ART

When the mobile terminal, for example, a mobile phone, works, the CPU (Central Processing Unit) dissipates a lot of heat, so that temperature in an electronic device is raised rapidly, and therefore, it is needed to cool the CPU. The heat dissipation design philosophy of a liquid cooling heat dissipation technology is originated from principle and concept of heat dissipation of a conventional computer. It aims to exert performance of the CPU by means of power heat dissipation ability, thereby bringing experience of high game operating speed and low temperature to users.

At present, the technology has been applied to the mobile phone gradually, and in particular, the input end of the heat tube clings to the heating element and the condensing end of the heat tube is inlaid into an aluminum alloy middle frame of the mobile terminal. The hollow heat tube is internally filled with a liquid, heat enters from the input end, the liquid at the input end is heated to evaporate and penetrates the hollow heat tube to be cooled gradually at the condensing end lower in temperature, and vapor becomes the liquid again. The process is repeated continuously and heat generated by the heating element is transferred to a large area aluminum alloy middle frame heat dissipator quickly, so that quick and effective heat dissipation is performed. However, the structure dissipating heat in this way is complex and low in heat dissipating efficiency.

However, the structure for dissipating heat in this way is complex and provides low heat dissipating efficiency.

Therefore, it is necessary to provide a novel speaker box device to solve the technical problem.

SUMMARY OF THE INVENTION

One of the main objects of the present invention is to provide a speaker box device with improved heat dissipation efficiency.

Accordingly, the present invention discloses a speaker box device, comprising:

a speaker box including a housing body, and a speaker unit in the housing body; the speaker unit comprising a diaphragm for vibrating to generate a sound, and the diaphragm being spaced from the housing body for forming a front acoustic cavity; wherein the speaker box further comprises a sound outlet channel communicating the front acoustic cavity to the outside; the front acoustic cavity and the sound outlet channel jointly form a front cavity;

a heating element separated from the speaker box;

wherein the speaker box device further comprises a heat conductor having a first end part connected to the heating element, a second end part extending into the front cavity and a connection part connecting the first end part to the second end part; the housing body includes a through hole penetrating therethrough at a position corresponding to the front cavity, and the second end part of the heat conductor stretches into the front cavity from the through hole.

In addition, the second end part is arranged directly opposite to the diaphragm.

In addition, the housing body comprises an upper cover and a lower cover matched with each other, and the through hole is formed in the upper cover; the connection part further comprises a conduction section and a bending section; the first end part, the conduction section, the bending section and the second end part are connected successively; the bending section is arranged in the through hole in a penetrating manner; the conduction section is attached to the outer surface of the upper cover; and the second end part is attached to the inner surface of the upper cover.

In addition, a first mounting slot is formed in the inner surface of the upper cover, a second mounting slot is formed in the outer surface of the upper cover, the through hole communicates the first mounting slot to the second mounting slot, the second end part is mounted in the first mounting slot, and the conduction section is mounted in the second mounting slot.

In addition, the heat conductor is a heat tube.

The present invention further discloses a mobile terminal, comprising a terminal housing with a sound outlet and a speaker box device as described above; wherein the speaker box and the heating element are mounted in the terminal housing in a spaced manner, and the sound outlet channel communicates with the sound outlet.

In addition, the heating element is one or two of a central processing unit and a battery.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
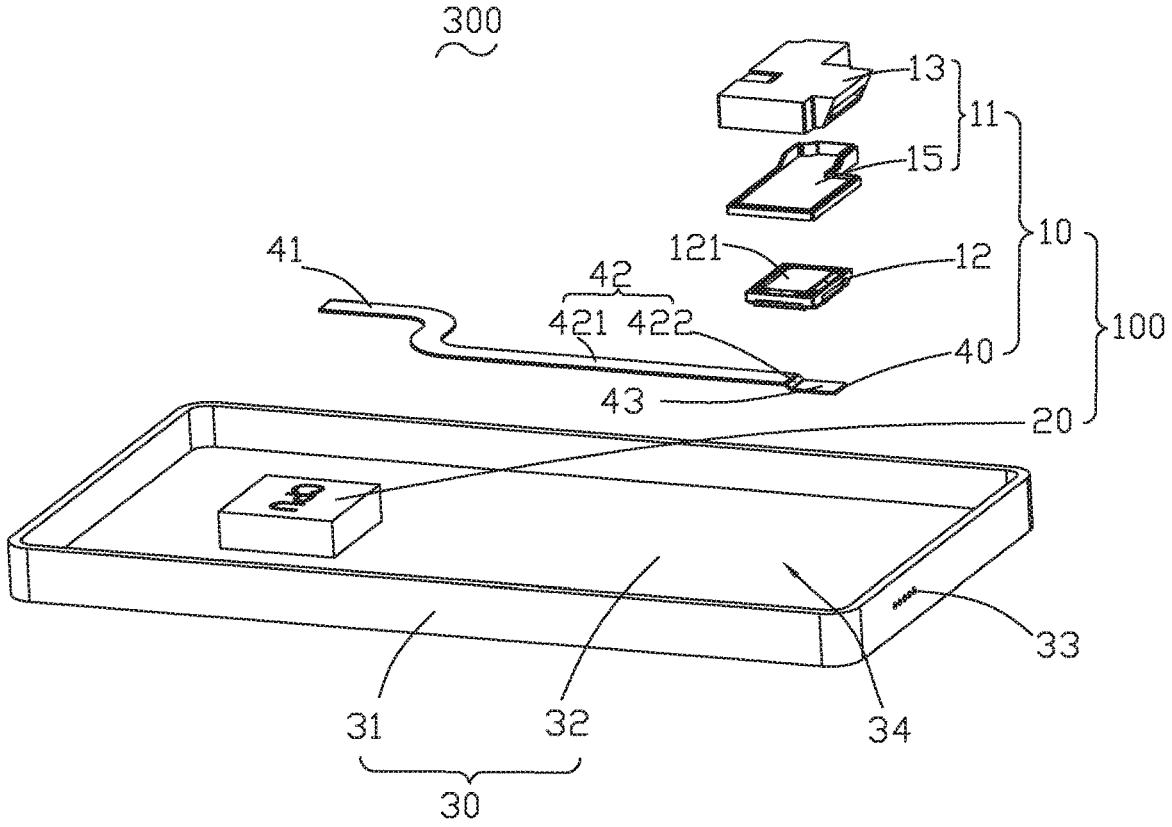
FIG. 1 is an exploded view of a mobile terminal provided by an embodiment of the present application.

Shown in the FIG. 1, a mobile terminal 300 provided by the present application comprises a speaker box device 100 and a terminal housing 30. The terminal housing 30 comprises a side wall 31, a bottom wall 32 and a containment space 34 formed by jointing the side wall 31 and the bottom wall 32 to accommodate the speaker device 100. The side wall 31 is provided with a sound outlet 33 for propagating a sound sent by the speaker device 100. Preferably, the mobile terminal 300 is a mobile phone.

Figure 2:
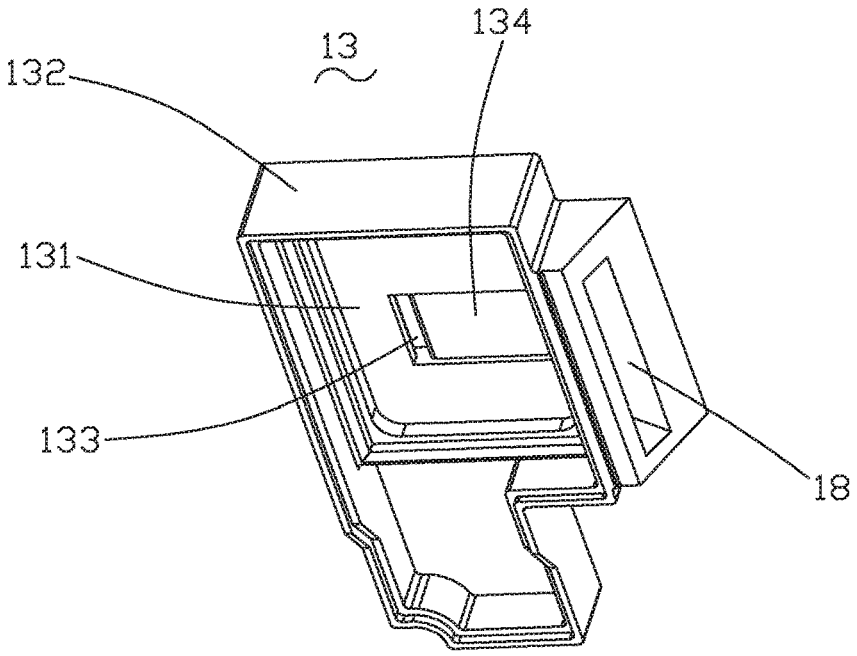
FIG. 2 is an isometric view of a upper cover of a speaker device (a heating element not included) in FIG. 1.
Figure 3:
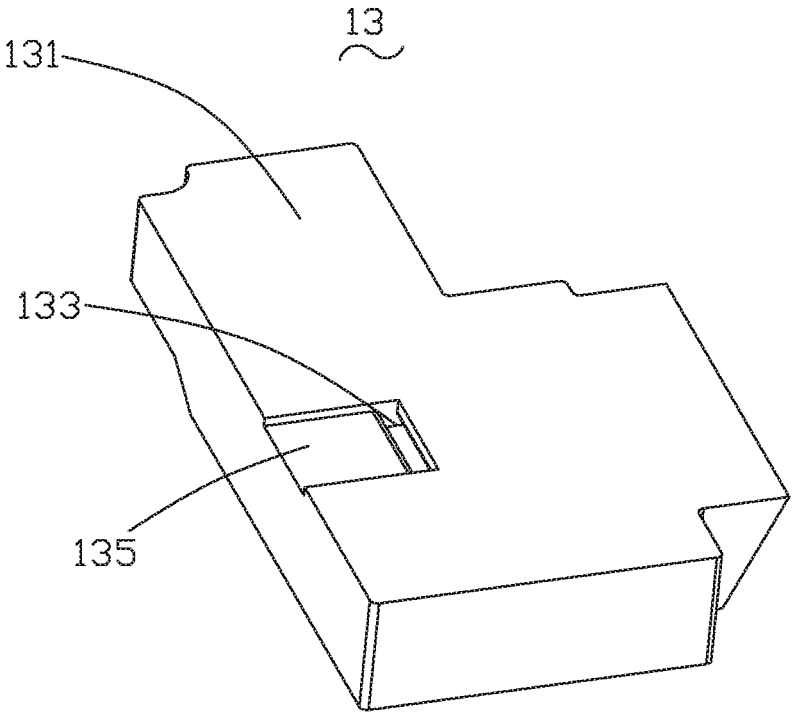
FIG. 3 is similar to FIG. 2, but from another aspect.
Figure 6:
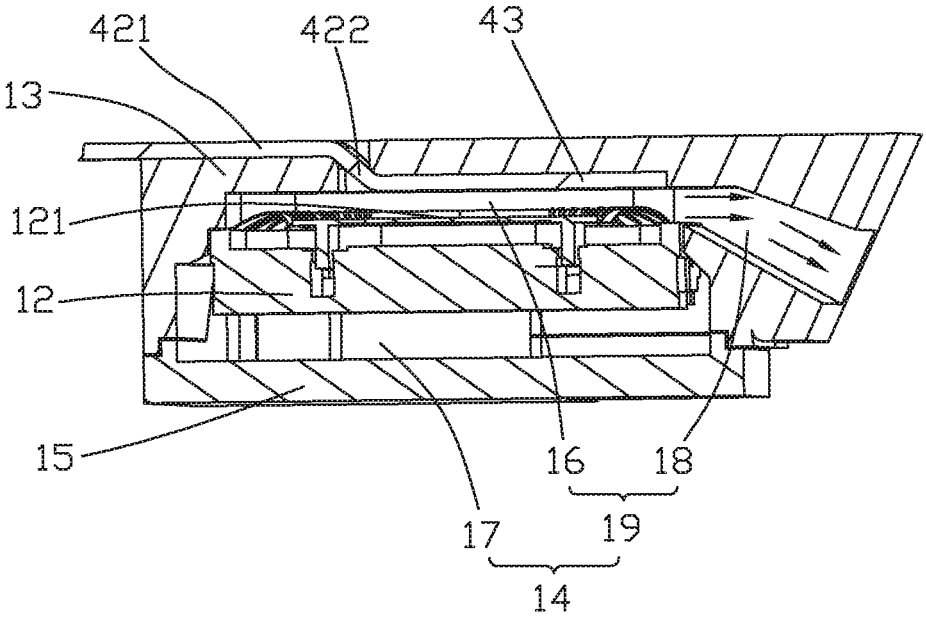
FIG. 6 is a cross-sectional view taken along line A-A in FIG. 5.

With reference to FIG. 2, FIG. 3 and FIG. 6, the speaker box device 100 comprises a speaker box 10, a heating element 20 arranged separated from the speaker box 10 and a heat conductor 40 connecting the speaker box 10 to the heating element 20. The speaker box 10 comprises a housing body 11 and a speaker unit 12 accommodated in the housing body 11. The housing body 11 comprises an upper cover 13, a lower cover 15 matched with the upper cover 13 to form an accommodation space 14 and the speaker unit 12 accommodated in the accommodation space 14. The upper cover 13 and the lower cover 14 can be either of an integrated structure or a split structure.

The speaker unit 12 and the upper cover 13 are arranged in a spaced manner and jointly encircle a front acoustic cavity 16; the speaker unit 12, the upper cover 13 and the lower cover 15 jointly encircle a back cavity 17.

The speaker box 10 further comprises a sound outlet channel 18 communicating to the outside. The sound outlet channel 18 communicates to the front acoustic cavity 16 to form a front cavity 19. In the embodiment, the sound outlet channel 18 is formed in the upper cover 13. The sound outlet channel 18 communicates to the outside through the sound outlet 33.

In the embodiment, the speaker unit 12 separates the accommodation space 14 into the front cavity 19 and the back cavity 17. The front cavity 19 comprises the front acoustic cavity 16 and the sound outlet channel 18 for generating a sound; the back cavity 17 is used for improving the low frequency acoustic performance of the speaker box 10.

Particularly, the speaker unit 12 comprises a diaphragm 121. The diaphragm 121 and the upper cover 13 are arranged in a spaced manner to form the front acoustic cavity 16.

The upper cover 13 comprises a top wall 131 which is substantially tabulate, an extension wall 132 formed by bending and extending along the edge of the top wall 131 and a through hole 133 penetrating the top wall 131. The extension wall 132 is arranged around the top wall 131. The sound outlet channel 18 is formed on the extension wall 132. The inner surface of the top wall 131 is provided with a first mounting slot 134 formed far away from the speaker unit 12, the outer surface of the top wall 131 is provided with a second mounting slot 135 sinking toward the front cavity 19, and the through hole 133 communicates the first mounting slot 134 to the second mounting slot 135.

Figure 4:
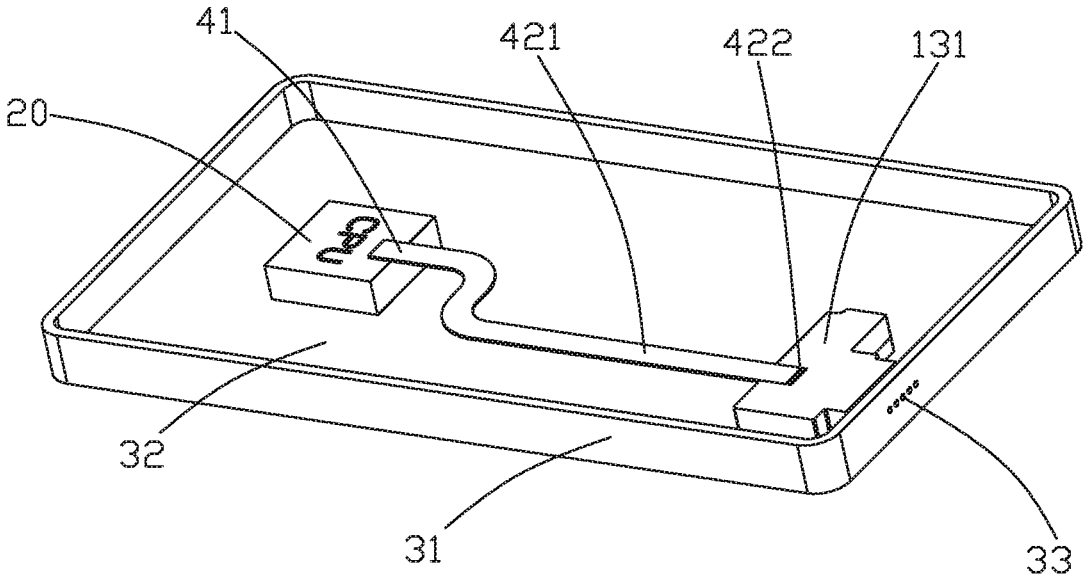
FIG. 4 is an isometric view of the mobile terminal in FIG. 1.
Figure 5:
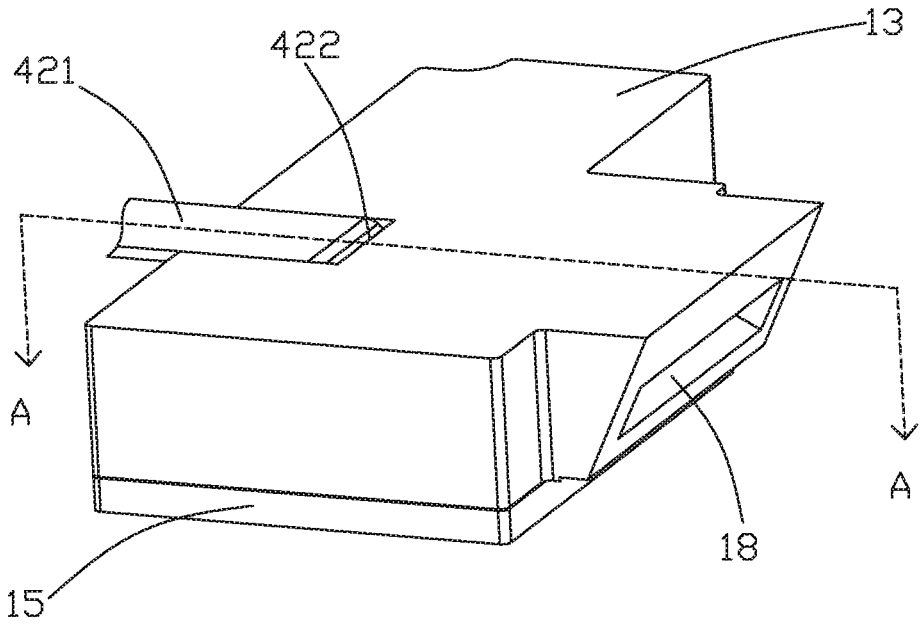
FIG. 5 is an isometric view of the speaker device in FIG. 4.

With reference to FIG. 4 and FIG. 5, the heat conductor 40 comprises a first end part 41, a connection part 42 and a second end part 43 connected successively. The connection part 42 comprises a connection section 421 and a bending section 422. The first end part 141, the connection section 421, the bending section 422 and the second end part 43 are connected successively, the bending section 422 is arranged in the through hole 133 of the upper cover 13 in a penetrating manner, the conduction section 421 is attached to the outer surface of the top wall 131 and the second end part 43 is attached to the inner surface of the top wall 131.

Particularly, the conduction section 421 is mounted in the second mounting slot 135 of the top wall 131 of the upper cover 13, and the second end part 43 is mounted in the first mounting slot 134. By means of the arrangement, it is ensured that the second end part 124 of the heat conductor 120 is located in the front cavity 19. Preferably, the second end part 43 is directly opposite to the diaphragm 121. The heat conductor 120 is of an integrally formed structure and is a heat tube in which a phase change medium is sealed. The phase change medium is any one of acetone, methanol or ethanol. Or, the heat conductor 120 is made from a heat conducting metal or a heat conducting silica gel, and the heat conducting metal can be a copper alloy or an aluminum alloy. Preferably, the heat conductor 120 is a heat conducting tube.

The heating element 20 and the speaker box 10 are fixed to the bottom wall 32 of the terminal housing 30 in a spaced manner, the sound outlet channel 18 of the speaker box 10 communicates to the sound outlet 33 of the terminal housing 30, the first end part 41 of the heat conductor 40 is connected to the heating element 20, and heat of the heating element 20 is dissipated by means of the heat conductor 40 and the speaker box 10. The heating element 20 is any part, with heat dissipation demand, in the central processing unit, the battery or the mobile phone.

With reference to FIGS. 1-6, description on the working process of the speaker box device 100 and the mobile terminal 300 is given in combination with the drawings.

During work, the heating element 20 dissipates a lot of heat, the first end part 41 of the heat conductor 40 is attached to the heating element 20, the first end part 41 absorbs heat dissipated by the heating element 20, the connection part 42 is used for transferring heat collected by the first end part 41 to the second end part 43, and the second end part 43 is used for transferring heat to outside air. The second end part 43 stretches into the front cavity 19, so that the diaphragm 121 vibrates to push air In THE Front cavity 19 to flow to form the air cooling effect to dissipate heat transferred by the second end part 43 through the sound outlet 33.

It is to be noted that the speaker box 10 can input a pulse signal of lower frequency (lower than 1000 Hz) when executing heat dissipation work to drive the diaphragm 121 to vibrate to push the air in the front cavity 19 to flow to form the air cooling effect. When the speaker box 10 does not execute a music play task, the speaker box 10 can play the pulse signal independently. When the speaker box 10 executes the music play task, the speaker box can superpose the pulse signal into a music signal. Since the signal is a pulse signal of an ultralow frequency, the signal is not heard by ears, and a normal hearing effect is not affected.

Compared with the prior art, according to the speaker device 100 and the mobile terminal 300 provided by the present application, the first end part 41 of the heat conductor 40 is attached to the heating element 20 and the second end part 43 is inserted into the front cavity 19 of the speaker box 10 through the through hole 133 of the upper cover 13 of the speaker box 10. The diaphragm 121 of the speaker unit 12 vibrates in the front cavity 19 to generate an air flow which brings heat of the second end part 43. Heat conducted by the heat conductor 40 is discharged through the sound outlet 33 by means of the air cooling effect formed by air flow. In this way, heat dissipation of the mobile terminal 300 can be achieved by adopting a simple structure, and the heat dissipation efficiency is high.

What has been described above is only the embodiment of the present application. It should be pointed out here that for ordinary technicians in this field, improvements can be made without departing from the inventive concept of the present application, but these all belong to the protection scope of the present application.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box device, comprising:

a speaker box including a housing body, and a speaker unit in the housing body; the speaker unit comprising a diaphragm for vibrating to generate a sound, and the diaphragm being spaced from the housing body for forming a front acoustic cavity; wherein the speaker box further comprises a sound outlet channel communicating the front acoustic cavity to the outside; the front acoustic cavity and the sound outlet channel jointly form a front cavity;

a heating element separated from the speaker box;

wherein the speaker box device further comprises a heat conductor having a first end part connected to the heating element, a second end part extending into the front cavity and a connection part connecting the first end part to the second end part; the housing body includes a through hole penetrating therethrough at a position corresponding to the front cavity, and the second end part of the heat conductor is arranged directly opposite to the diaphragm and stretches into the front cavity from the through hole.

2. The speaker box device as described in claim 1, wherein the housing body comprises an upper cover and a lower cover matched with each other, and the through hole is formed in the upper cover; the connection part further comprises a conduction section and a bending section; the first end part, the conduction section, the bending section and the second end part are connected successively; the bending section is arranged in the through hole in a penetrating manner; the conduction section is attached to the outer surface of the upper cover; and the second end part is attached to the inner surface of the upper cover.

3. The speaker box device as described in claim 2, wherein a first mounting slot is formed in the inner surface of the upper cover, a second mounting slot is formed in the outer surface of the upper cover, the through hole communicates the first mounting slot to the second mounting slot, the second end part is mounted in the first mounting slot, and the conduction section is mounted in the second mounting slot.

4. The speaker box device as described in claim 1, wherein the heat conductor is a heat tube.

5. A mobile terminal, comprising a terminal housing with a sound outlet and a speaker box device as described in claim 1; wherein the speaker box and the heating element are mounted in the terminal housing in a spaced manner, and the sound outlet channel communicates with the sound outlet.

6. A mobile terminal, comprising a terminal housing with a sound outlet and a speaker box device as described in claim 2; wherein the speaker box and the heating element are mounted in the terminal housing in a spaced manner, and the sound outlet channel communicates with the sound outlet.

7. A mobile terminal, comprising a terminal housing with a sound outlet and a speaker box device as described in claim 3; wherein the speaker box and the heating element are mounted in the terminal housing in a spaced manner, and the sound outlet channel communicates with the sound outlet.

8. A mobile terminal, comprising a terminal housing with a sound outlet and a speaker box device as described in claim 4; wherein the speaker box and the heating element are mounted in the terminal housing in a spaced manner, and the sound outlet channel communicates with the sound outlet.

9. The speaker box device as described in claim 1, wherein the heating element is one or two of a central processing unit and a battery.

10. The speaker box device as described in claim 2, wherein the heating element is one or two of a central processing unit and a battery.

11. The speaker box device as described in claim 3, wherein the heating element is one or two of a central processing unit and a battery.

12. The speaker box device as described in claim 4, wherein the heating element is one or two of a central processing unit and a battery.

* * * * *